US009193179B2

(12) United States Patent
Numata

(10) Patent No.: US 9,193,179 B2
(45) Date of Patent: Nov. 24, 2015

(54) TREATMENT AGENT LIQUID APPLICATION DEVICE FOR INK JET PRINTER

(71) Applicant: Hironori Numata, Ibaraki (JP)

(72) Inventor: Hironori Numata, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/328,915

(22) Filed: Jul. 11, 2014

(65) Prior Publication Data

US 2015/0022600 A1 Jan. 22, 2015

(30) Foreign Application Priority Data

Jul. 22, 2013 (JP) ..... 2013-151917

(51) Int. Cl.
*B41J 2/01* (2006.01)
*B41J 11/00* (2006.01)
*B05C 1/08* (2006.01)

(52) U.S. Cl.
CPC ..... *B41J 11/0015* (2013.01); *B05C 1/08* (2013.01)

(58) Field of Classification Search
CPC ..... B41J 2/2114; B41J 11/0015; B41J 2/01; B41M 5/52; B41M 7/00
USPC ..... 347/101, 104
See application file for complete search history.

(56) References Cited

U.S. PATENT DOCUMENTS

| | | | | |
|---|---|---|---|---|
| 5,724,629 | A * | 3/1998 | Iino et al. | 399/57 |
| 8,573,732 | B2 | 11/2013 | Hoshino et al. | |
| 2012/0060754 | A1 * | 3/2012 | Kitaoka et al. | 118/114 |
| 2012/0128394 | A1 * | 5/2012 | Sato | 399/351 |
| 2012/0229580 | A1 | 9/2012 | Ohba | |
| 2012/0321363 | A1 * | 12/2012 | Nakane et al. | 399/346 |
| 2013/0106946 | A1 * | 5/2013 | Sunaoshi | 347/21 |

FOREIGN PATENT DOCUMENTS

| | | |
|---|---|---|
| JP | 2012-056261 | 3/2012 |
| JP | 2012-196955 | 10/2012 |
| JP | 2012-218374 | 11/2012 |

* cited by examiner

*Primary Examiner* — Manish S Shah
*Assistant Examiner* — Yaovi Ameh
(74) *Attorney, Agent, or Firm* — Cooper & Dunham LLP

(57) ABSTRACT

A treatment agent liquid application device for an ink jet printer includes a supply pan including a liquid chamber that stores treatment agent liquid; an application roller that applies the treatment agent liquid on a record surface of a recording medium; a squeeze roller that rotates to draw up a part of the treatment agent liquid in which a part of the squeeze roller is immersed in the supply pan and to supply the treatment agent liquid to a pressure contact part between the application roller and the squeeze roller; and a partition member arranged outside the squeeze roller and along a circumferential direction of the squeeze roller in the supply pan, the partition member dividing the liquid chamber in the supply pan into a liquid chamber on a squeeze roller side and an external liquid chamber outside the liquid chamber on the squeeze roller side.

12 Claims, 4 Drawing Sheets

TREATMENT AGENT LIQUID APPLICATION DEVICE FOR INK JET PRINTER

BACKGROUND OF THE INVENTION

1. Field of the Invention

The disclosures herein generally relate to a treatment agent liquid application device for an ink jet printer. The disclosures, in particular, relate to a treatment agent liquid application device for an ink jet printer that applies a treatment agent such as a blurring inhibitor that inhibits an image blurring in the ink jet printer, which makes ink droplets impact onto an recording medium such as a paper, for example, to form an image, onto a recording surface prior to the image formation.

2. Description of the Related Art

Recently, ink jet printers have rapidly become widespread, since an image formation by an ink jet type has advantages of a low noise, a low running cost and a function of color printing. Such ink jet printers include a serial printer and a line printer. The serial printer prints an image by combining a movement in a main scanning direction in which ink droplets are discharged while a record head moves in the main scanning direction (a width direction of the recording medium) and a movement of the rewording medium in a sub scanning direction. The line printer is provided with a line head having a print width for the width of the recording medium, and prints while moving the line head and the recording medium relatively.

The line printer includes a continuous paper printer which uses a continuous paper as a recording medium, which is suitable for large amounts of printing. The continuous paper printer prints while conveying continuous paper wound in a roll at high speed (for example, 0.5 to 2 m/s).

On the other hand, there is an ink jet printer having a configuration of printing both sides of a continuous paper, from a standpoint of resource saving, by a tandem operation using two continuous paper printers, i.e. printing a first side of the continuous paper (for example, top side) by the first continuous paper printer, inverting the continuous paper, and printing a second side of the continuous paper (for example, back side) by the second continuous paper printer.

Recently, in the above-described ink jet printers, image quality becomes higher and higher, since a discharge timing of an ink droplet and a size of an ink droplet can be finely controlled. However, in the ink jet printer, ink droplets are discharged to form an image, and until the ink droplets are dried, impacted dots blur along a paper fiber. Accordingly, a phenomenon such as feathering or color bleed, in which a color border becomes blurred by mixing with an adjacent ink droplet with different color, easily occurs, and the quality of an image degrades.

As a method of inhibiting the degradation of the quality of the image, there is the art of applying treatment agent liquid such as a blurring inhibitor on the recording medium as a preprocessing, so as to inhibit the blurring of ink by aggregating a component of pigment in the ink droplet.

Such kind of treatment agent liquid application device as above includes a supply pan that stores the treatment agent liquid, an application roller that applies the treatment agent liquid on a record surface of the recording medium, a squeeze roller that draws up the treatment agent liquid in the supply pan, thins the treatment agent liquid and transfers it to the application roller, a pressure roller that conveys the recording medium while holding it with the application roller, and the like.

In the treatment agent liquid application device as described above, it is proposed that in order to remove a foreign matter such as paper dust attached on a surface of the squeeze roller, a swirling current with high flow velocity is generated in the supply pan, and a partition which is orthogonal to a rotational direction of the squeeze roller is provided.

Moreover, it is proposed that in order to prevent the treatment agent liquid in the supply pan from evaporating, the treatment agent liquid, the squeeze roller and the application roller are housed in the supply pan (housing).

For example, Japanese Published Patent Applications No. 2012-238374 and 2012-56261 disclose the treatment agent liquid application device described as above.

In the treatment agent liquid application device of the related art, when the treatment agent liquid is drawn up by rotating the squeeze roller a part of which is immersed in the treatment agent liquid in the supply pan, a position of fluid level varies greatly, and a liquid amount of the treatment agent liquid in the supply pan may not be detected correctly.

Accordingly, an uneven application or an application failure may occur due to an insufficient supply of the treatment agent liquid, and the function of the treatment agent liquid cannot be fulfilled. Moreover, contrary to the above, due to an excess in supply of the treatment agent liquid, the treatment agent liquid overflows from the supply pan into the application device and a liquid dispersion occurs. Accordingly, a problem that the inside of the application device is smeared or an electric part is damaged will occur.

The shortage of supply or the excess in supply of the treatment agent liquid, described as above, depends on a speed of application of the treatment agent liquid. Particularly, for the application device in which plural application speeds are set, it is necessary to be careful so that the shortage of supply or the excess in supply of the treatment agent liquid does not occur for each of the application speeds.

Moreover, the shortage of supply or the excess in supply also depends on a viscosity of the treatment agent liquid. It is necessary to respond to a change in the viscosity of the treatment agent liquid associated with water evaporation. Particularly, for the application device using plural kinds of treatment agent liquids, changes in viscosity characteristic of which are different from each other, the above-described problem becomes complicated.

Japanese Published Patent Applications No. 2012-218374 and 2012-56261 do not disclose suppressing the variation of the position of the fluid level which occurs when the treatment agent liquid is drawn up by the squeeze roller rotating, and resolving the problem due to the shortage of supply or the excess in supply of the treatment agent liquid.

SUMMARY OF THE INVENTION

It is a general object of at least one embodiment of the present invention to provide a treatment agent liquid application device for an ink jet printer that substantially obviates one or more problems caused by the limitations and disadvantages of the related art.

In one embodiment, a treatment agent liquid application device for an ink jet printer includes a supply pan including a liquid chamber that stores treatment agent liquid; an application roller that applies the treatment agent liquid on a record surface of a recording medium; a squeeze roller that rotates to draw up a part of the treatment agent liquid in which a part of the squeeze roller is immersed in the supply pan and to supply the treatment agent liquid to a pressure contact part between the application roller and the squeeze roller; and a partition member arranged outside the squeeze roller and along a circumferential direction of the squeeze roller in the supply pan, the partition member dividing the liquid chamber in the supply pan into a liquid chamber on a squeeze roller side and an external liquid chamber outside the liquid chamber on the squeeze roller side.

The treatment agent liquid application device according to the present invention includes a liquid chamber on a squeeze roller side and a liquid chamber on an external side which are separated from each other, and a variation of the treatment agent liquid due to a rotation of a squeeze roller can be prevented from transmitting to the liquid chamber on the external side. Therefore, the problem due to the variation of the treatment agent liquid is resolved. According to the present invention, a treatment agent liquid application device for an ink jet printer with a good operation reliability, which can apply the treatment agent liquid properly and in which neither a shortage of supply nor an excess in supply of the treatment agent liquid for a recording medium occurs, can be provided.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

First Embodiment

Figure 5:
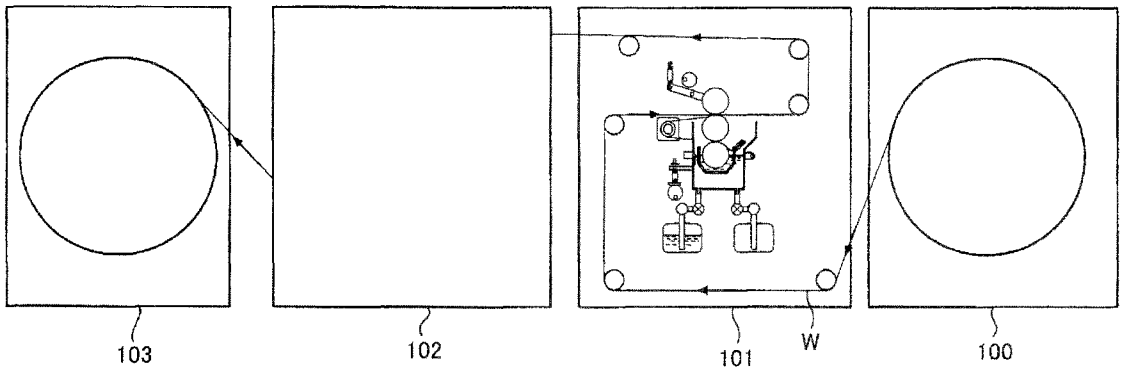
FIG. 5 is a flowchart illustrating a schematic configuration of an image forming system according to the first embodiment.

FIG. 5 is a flowchart illustrating a schematic configuration of an image forming system according to the first embodiment.

As shown in FIG. 5, a recording medium W including an elongated continuous paper reeled out from a paper feed device 100 is, at first, sent into a treatment agent liquid application device 101, and a preprocessing is performed by applying a treatment agent liquid such as an inhibitor on a surface of the recording medium W.

Next, the processed recording medium W is sent into an ink jet printer 102. A desired image is formed by discharging ink droplets onto the surface of the recording medium W. Then, the recording medium W is sent into a post-processing device 103, and a predetermined processing is performed for the recording medium W.

A speed of application of the treatment agent liquid in the above-described system can be arbitrarily set in a range from 50 m/min to 150 m/min.

Figure 1:
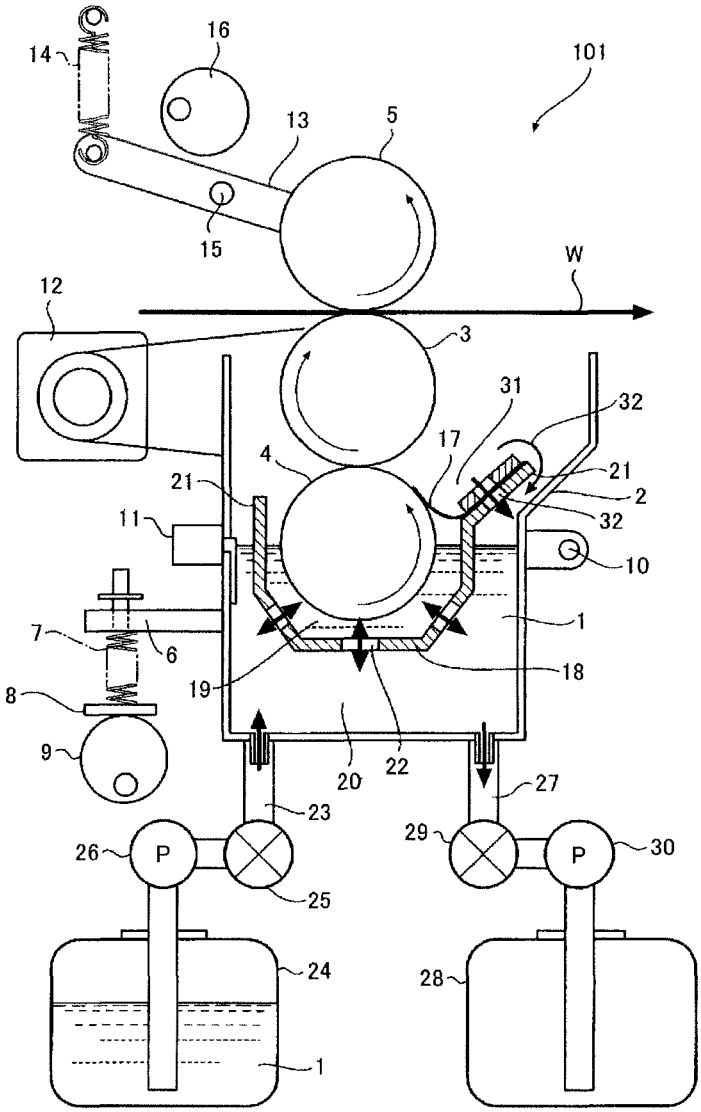
FIG. 1 is a diagram illustrating an example of a schematic configuration of a treatment agent liquid application device according to a first embodiment.
Figure 2:
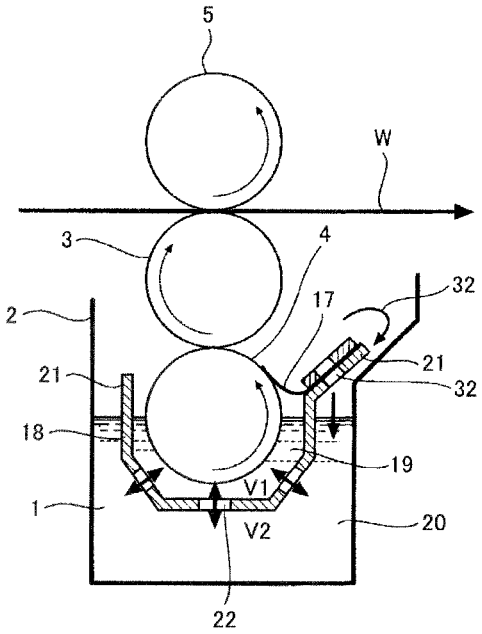
FIG. 2 is an explanatory diagram illustrating an example of a relation between a liquid chamber on a squeeze roller side and a liquid chamber on an external side in the treatment agent liquid application device according to the first embodiment.

FIG. 1 is a diagram illustrating a schematic configuration of the treatment agent liquid application device 101 used in the above-described image forming system according to the present embodiment, and shows a state of applying the treat agent liquid.

The treatment agent liquid application unit 101 includes a supply pan 2 that stores the treatment agent liquid 1, an application roller 3 that applied the treatment liquid 1 on a record surface of the recording medium W, a squeeze roller 4 that draws the treatment agent liquid 1 from the supply pan 2, thins the treatment agent liquid and transfers it to the application roller 3, a pressure roller 5 that conveys the recording medium W while holding it with the application roller 3, and the like.

A component of the treatment agent liquid 1 is arbitrarily selected taking account of, for example, a component of ink used in the ink jet printer 102, a material of the recording medium W, or the like.

To a side plate of the supply pan 2, a base end section of an arm 6 is connected. To a free end section of the arm 6, a pin 8 is attached via a compression spring 7. The pin 8 elastically contacts with a periphery of an eccentric cam 9 by a restitution force of the compression spring 7.

The squeeze roller 4 is rotatably supported by the side plate of the supply pan 2, though it is not shown in figures, and faces the application roller 3 which is arranged on the upper side. According to a rotation of the eccentric cam 9, a pressure force from the compression spring 7 changes, and the whole supply pan 2 oscillates around an oscillation pin 10 as a support point. Along with the oscillation, a position of the squeeze roller 4 is also changed. A state shown in FIG. 1 is an application state where the squeeze roller 4 is pressed to contact the application roller 3.

In the supply pan 2, a predetermined amount of treatment agent liquid is fed. The amount of liquid is monitored by a fluid level sensor 11 provided on the side plate of the supply pan 2. Approximately the lower half of the squeeze roller 4 is immersed in the treatment agent liquid 1.

The application roller 3 and the squeeze roller are coupled by a gear, which is not shown, by a motor 12 which rotationally drives the application roller 3. The application roller 3 and the squeeze roller 4 rotate synchronously. Then, the treatment agent liquid 1 is drawn up by the rotation of the squeeze roller 4. Excess treatment agent liquid is scraped off by a blade 17 which contacts a periphery of the squeeze roller 4 in a sliding fashion.

A predetermined amount of the treatment agent liquid 1 is conveyed to a nip portion between the squeeze roller 4 and the application roller 3. By the treatment agent liquid 1 passing through the nip portion a thin film of the treatment agent liquid 1 which is formed in an infinitesimally uniform manner on the surface of the application roller 3.

The pressure roller is supported at a free end of a turning arm 13 rotatably, and to a base end of the turning arm 13 an extension spring 14 is connected. An intermediate part of the turning arm 13 is supported by an oscillation pin 15. An eccentric cam is in contact with a side of the turning arm 13. By rotating the eccentric cam 16, the pressure roller 5 can be separated from the application roller 3 against a tensile force by the extension spring 14.

By pressing the recording medium against the application roller 3 by the pressing roller 5, the thin film of the treatment agent liquid 1 supported on the application roller 3 is transferred to and applied onto the recording medium W.

To the supply pan 2, a supply tank 24 is connected via a feed pipe 23. On the feed pipe 23, a feed valve 25 and a feed pump 26 are arranged. The fluid level sensor 11 that monitors a fluid level of the treatment agent liquid 1 in the supply pan 2 is arranged at a position where a fluid level in an external liquid chamber, which will be described later, in the supply pan 2 can be detected.

The supply tank 24 includes a cartridge which is highly airtight filled with the new treatment agent liquid 1; a reservoir tank which is more airtight than the supply pan 2, retracts the treatment agent liquid 1 from the supply pan 2 and stores it when the application of the treatment agent liquid is not performed for a long period of time, and returns the treatment agent liquid 1 to the supply pan 2 when the treatment agent liquid is used; or both the cartridge and the reservoir tank.

When the fluid level of the treatment agent liquid 1 lowers due to the use of the treatment agent liquid 1, the fluid level sensor 11 detects it, by opening the feed valve 25 and activating the feed pump 26, the treatment agent liquid 1 in the supply tank 24 is sent into the supply pan 2 (external liquid chamber 20) through the feed pipe 23.

When the fluid level reaches a desired position, by closing the feed valve 25 and stopping the activation of the feed pump 26, a constant fluid level of the treatment agent liquid 1 in the supply tank 24 is maintained. In the present embodiment, the treatment agent liquid 1 is filled up to a level around a rotation center of the squeeze roller 4, as shown in FIG. 1.

Moreover, taking in account the degradation or property due to a thickening or the like of the treatment agent liquid 1, in order to gradually eject the treatment agent liquid 1 to the outside of the system, a waste tank 28 is connected to the supply pan 2 via an exhaust pipe 27. On the exhaust pipe 27, an exhaust valve 29 and an exhaust pump 30 are arranged.

By opening the exhaust valve 29 and activating the exhaust pump 30, the degraded treatment agent liquid 1 in the supply tank 24 is ejected into the waste tank 28 through the exhaust pipe 27.

Between the supply pan 2 and the squeeze roller 4, and at a position near the squeeze roller, a partition member 18 having an approximately U-shaped cross section is arranged along a circumferential direction of the squeeze roller 4. Both end portions of the partition member 18 are projected upward from the fluid level of the treatment agent liquid 1. According to the arrangement of the partition member 18, the liquid chamber in the supply pan 2 has a configuration including two liquid chambers in which a liquid chamber 19 on the squeeze roller side surrounding a lower part of the squeeze roller 4 is separated (divided) from an external liquid chamber 20 outside the liquid chamber 19.

A volume V2 of the external liquid chamber 20 is greater than a volume V1 of the liquid chamber 19 on the squeeze roller side, i.e. V1<V2. More specifically, the volume V2 of the external liquid chamber 20 is more than five times greater than the volume V1 of the liquid chamber 19 on the squeeze roller side. In the present embodiment, the volume V2 is ten times the volume V1, i.e. V2=V1*10. Meanwhile, on the partition member 18, plural though holes 22 are formed so that the treatment agent liquid 1 can be input to/output from the liquid chamber 19 on the squeeze roller side from/to the external liquid chamber 20.

Meanwhile, a diameter of the through hole 22 is determined taking in account the damper effect of the treatment agent liquid 1 passing through the through hole 22.

According to the partition member 18, a laminar flow generated in the liquid chamber 19 on the squeeze roller side by the rotation of the squeeze roller is prevented from travelling to the external liquid chamber 20. Furthermore, according to the damper effect by the treatment agent liquid flowing between the liquid chamber 19 on the squeeze roller side and the external liquid chamber 20, a variation of the fluid level in the external liquid chamber 20 can be prevented or suppressed.

Accordingly, the fluid level sensor 11 can always detect a proper fluid level, and can remove the insufficient supply of the treatment agent liquid 1 or the excess in supply of the treatment agent liquid.

Moreover, above the liquid chamber 19 on the squeeze roller side and on a downstream side of the rotational direction of the squeeze roller 4, the blade 17 is provided which is pressed in contact with the periphery of the squeeze roller 4. The blade prevents the variation of the fluid level due to an excess drawing of the treatment agent liquid 1.

The blade 17 includes a plate having a rectangular shape. The blade 17 is curved, and a curved surface of the blade 17, not an edge part of the blade 17, is pressed in contact with the periphery of the squeeze roller 4.

The curved surface contacts the periphery of the squeeze roller 4 in order to ensure a stable amount of supply of the treatment agent liquid 1 irrespective of a number of revolutions of the squeeze roller 4. In the case where the edge part of the blade 17 is pressed in contact with the periphery of the squeeze roller 4 a state of pressing of the edge part into the squeeze roller 4 changes depending on the number of revolutions of the squeeze roller 4.

In order to return the excess treatment agent liquid 1 scraped off by the blade to the external liquid chamber 20 from a space 31 above the blade 17, a passing flow path 32 is provided. In the present embodiment, the passing flow path 32 includes a through hole formed on an overlapping part of the partition member 18 and the blade 17 or a top edge part of the overlapping part of the partition member 18 and the blade 17. Moreover, the passing flow path 32 includes a groove formed in the top edge of the overlapping part of the partition member 18 and the blade 17.

According to the passing flow path 32 formed as above the excess treatment agent liquid does not accumulate in the space 31 above the blade 17, and a scattering or an overflow of the treatment agent liquid 1 is prevented.

The blade 17 includes an elastic body such as, for example, a polyethylene resin sheet. A load of pressure contact of the blade with the squeeze roller 4 is set to greater than or equal to 2 kgf/m, which is sufficient for preventing an excess passing of the treatment agent liquid 1. As described above, by using the blade 17 including the elastic body and by setting the load of pressure contact as above, an accuracy of a part of the blade is relaxed. A strict adjustment becomes unnecessary, and a device conserving a space and with a low cost is provided.

Figure 3:
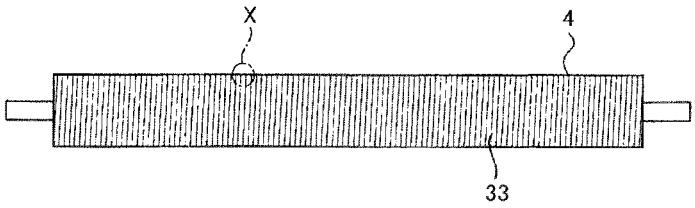
FIG. 3 is a diagram illustrating an example of a plan view of the squeeze roller used in the treatment agent liquid application device according to the first embodiment.
Figure 4:
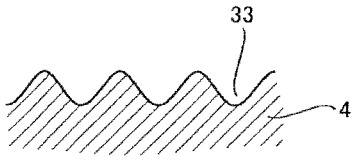
FIG. 4 is a diagram illustrating an example of an enlarged sectional view of a part of the squeeze roller used in the treatment agent liquid application device according to the first embodiment.

As shown in FIGS. 3 and 4, on a surface of the squeeze roller 4, large numbers of grooves 33 having a depth greater than 5 mm are formed along the circumferential direction of the squeeze roller 4. According to the grooves, an excess passing of the treatment agent liquid 1 due to an uplifting of the blade 17 associated with the number of revolutions of the squeeze roller or a viscosity of the treatment agent liquid 1 can be prevented.

FIG. 4 is an enlarged sectional view of a part, denoted by "X" in FIG. 3, of the squeeze roller 4 used in the treatment agent liquid application device according to the first embodiment, shown in FIG. 3. As shown in FIG. 4, the groove 33 formed on the surface of the squeeze roller 4 has a cross section of a shape of which is a form of a wave.

In the present embodiment, the supply pan 2 is divided into two liquid chambers, i.e. the liquid chamber 19 on the squeeze roller side and the external liquid chamber 20, by the partition member 18. However, plural partition members may be provided to divide the supply pan 2 into three or more liquid chambers. By dividing into three or more liquid chambers, the effect of suppressing a variation of a fluid level can be further improved, and it is an effective configuration for a specification where the number of revolutions of the squeeze roller 4 becomes larger and the fluid level varies enormously.

In the present embodiment, a treatment agent liquid application device for an ink jet printer includes a supply pan; an application roller; and a squeeze roller. A liquid chamber in the supply pan is divided into a liquid chamber on a squeeze roller side and an external liquid chamber outside the liquid chamber on the squeeze roller side by a partition member arranged along a circumferential direction of the squeeze roller.

Since the liquid chamber is divided into two or more tanks, i.e. the liquid chamber on the squeeze roller side and the external liquid chamber, a variation of the treatment agent liquid in the liquid chamber on the squeeze roller side due to a rotation of the squeeze roller can be prevented from travelling to the external liquid chamber, and a problem due to the variation of the treatment agent liquid, for example, a scattering of the treatment agent liquid, is resolved.

Moreover, the treatment agent liquid application device according to the present embodiment includes a fluid level sensor that detects a position of a fluid level of the treatment agent liquid in the external liquid chamber. According to the above feature, the position of the fluid level (amount of liquid) can be detected in the external liquid chamber in which the fluid level is stable.

In the treatment agent liquid application device according to the present embodiment, a through hole is provided in the partition member through which the treatment agent liquid flows from/into the liquid chamber on the squeeze roller side into/from the external liquid chamber. According to a damper effect of the treatment agent liquid flowing through the through hole, the flow of the treatment agent liquid in the liquid chamber on the squeeze roller side is suppressed, and the scattering of the treatment agent liquid or the like can be prevented.

In the treatment agent liquid application device according to the present embodiment, an upper end portion of the partition member is projected upward from the fluid level of the treatment agent liquid in the supply pan. Then, the liquid chamber is definitely divided by the partition member.

In the treatment agent liquid application device according to the present embodiment, a volume of the external liquid chamber is set so as to be greater than a volume of the liquid chamber on the squeeze roller side. Accordingly, the damper effect by the treatment agent liquid flowing through the through hole in the partition member is exerted more effectively, and the variation of the treatment agent liquid in the liquid chamber on the squeeze roller side is definitely suppressed.

In the treatment agent liquid application device according to the present embodiment, the volume of the external liquid chamber is more than five times greater than the volume of the liquid chamber on the squeeze roller side. Accordingly, the damper effect by the treatment agent liquid flowing through the through hole in the partition member is exerted more effectively, and the variation of the treatment agent liquid in the liquid chamber on the squeeze roller side is definitely suppressed.

In the treatment agent liquid application device according to the present embodiment, above the liquid chamber on the squeeze roller side, a blade pressed in contact with a periphery of the squeeze roller is provided. Accordingly, a variation of the fluid level due to an excess drawing of the treatment agent liquid by the squeeze roller is prevented.

In the treatment agent liquid application device according to the present embodiment, a flow path through which the treatment agent liquid can flow from a space above the blade to the external liquid chamber is provided. Accordingly, excess treatment agent liquid does not accumulate in the space above the blade, and a scattering or an overflow of the treatment agent liquid is prevented.

In the treatment agent liquid application device according to the present embodiment, the blade includes a plate having a rectangular shape. The blade is curved, and a curved surface of the blade, not an edge part of the blade, is pressed in contact with a periphery of the squeeze roller. A difference in a state of pressing of the blade into the squeeze roller due to a number of revolutions of the squeeze roller can be removed, and an amount of drawing up of the treatment agent liquid becomes stable. Furthermore, an uneven application, an application failure, an overflow of the treatment agent liquid, dispersion or the like can be prevented.

In the treatment agent liquid application device according to the present embodiment, a load of pressure contact of the blade with the squeeze roller is set greater than or equal to 2 kgf/m. Accordingly, the difference in the state of pressing of the blade Into the squeeze roller due to the number of revolutions of the squeeze roller can be removed, and the amount of drawing of the treatment agent liquid becomes stable. Furthermore, an uneven application, an application failure, an overflow of the treatment agent liquid, dispersion or the like can be prevented.

In the treatment agent liquid application device according to the present embodiment, a groove is formed on the periphery of the squeeze roller along a circumferential direction of the squeeze roller. Accordingly, an excess passing of the treatment agent liquid due to an uplifting of the blade associated with the number of revolutions of the squeeze roller or a viscosity of the treatment agent liquid can be prevented.

In the treatment agent liquid application device according to the present embodiment, the treatment agent liquid is a blurring inhibitor that inhibits a blurring of ink on a recording medium. Accordingly, a clear image without a blurring irrespective of a kind of the recording medium can be obtained.

Further, the present invention is not limited to these embodiments, but various variations and modifications ay be made without departing from the scope of the present invention.

The present application is based on and claims the benefit of priority Japanese Priority Application No. 2013-151917 filed on Jul. 22, 2013, the entire contents of which are hereby incorporated by reference.

What is claimed is:

1. A treatment agent liquid application device for an ink jet printer comprising:

a supply pan including a liquid chamber that stores treatment agent liquid;

an application roller that applies the treatment agent liquid on a record surface of a recording medium;

a squeeze roller that rotates to draw up a part of the treatment agent liquid in which a part of the squeeze roller is immersed in the supply pan and to supply the treatment agent liquid to a pressure contact part between the application roller and the squeeze roller; and a partition member arranged outside the squeeze roller and along a circumferential direction of the squeeze roller in the supply pan, the partition member dividing the liquid chamber in the supply pan into a liquid chamber on a squeeze roller side and an external liquid chamber outside the liquid chamber on the squeeze roller side, wherein the partition member has a U-shape configuration arranged along a circumferential direction of the squeeze roller.

2. The treatment agent liquid application device for the ink jet printer as claimed in claim 1, further comprising a fluid level sensor that detects a position of a fluid level of the treatment agent liquid in the external liquid chamber.

3. The treatment agent liquid application device for the ink jet printer as claimed in claim 1, wherein a through hole is provided in the partition member through which the treatment agent liquid flows from the liquid chamber on the squeeze roller side to the external liquid chamber and the treatment agent liquid flows from the external liquid chamber to the liquid chamber on the squeeze roller side.

4. The treatment agent liquid application device for the ink jet printer as claimed in claim 1, wherein an upper end portion of the partition member is projected upward from the fluid level of the treatment agent liquid in the supply pan.

5. The treatment agent liquid application device for the ink jet printer as claimed in claim 1, wherein a volume of the external liquid chamber is greater than a volume of the liquid chamber on the squeeze roller side.

6. The treatment agent liquid application device for the ink jet printer as claimed in claim 5, wherein the volume of the external liquid chamber is more than five times greater than the volume of the liquid chamber on the squeeze roller side.

7. The treatment agent liquid application device for the ink jet printer as claimed in claim 1, further comprising a blade that is provided above the liquid chamber on the squeeze roller side and is pressed in contact with a periphery of the squeeze roller.

8. The treatment agent liquid application device for the ink jet printer as claimed in claim 7, further comprising a flow path through which the treatment agent liquid flows from a space above the blade to the external liquid chamber.

9. The treatment agent liquid application device for the ink jet printer as claimed in claim 7, wherein the blade includes a plate having a rectangular shape, and a curved surface of the blade is pressed in contact with the periphery of the squeeze roller.

10. The treatment agent liquid application device for the ink jet printer as claimed in claim 7, wherein a load of pressure contact of the blade with the squeeze roller is set greater than or equal to 2 kgf/m.

11. The treatment agent liquid application device for the ink jet printer as claimed in claim 1, wherein a groove is formed on a periphery of the squeeze roller along a circumferential direction of the squeeze roller.

12. The treatment agent liquid application device for the ink jet printer as claimed in claim 1, wherein the treatment agent liquid includes a blurring inhibitor that inhibits a blurring of ink on a recording medium.

* * * * *